US009419338B2

(12) United States Patent
Chiu

(10) Patent No.: US 9,419,338 B2
(45) Date of Patent: Aug. 16, 2016

(54) ANTENNA APPARATUS

(71) Applicant: GETAC TECHNOLOGY CORPORATION, Hsinchu County (TW)

(72) Inventor: Shang-Ming Chiu, Taipei (TW)

(73) Assignee: Getac Technology Corporation, Hsinchu County (TW)

( * ) Notice: Subject to any disclaimer, the term of this patent is extended or adjusted under 35 U.S.C. 154(b) by 266 days.

(21) Appl. No.: 14/147,466

(22) Filed: Jan. 3, 2014

(65) Prior Publication Data

US 2015/0194734 A1 Jul. 9, 2015

(51) Int. Cl.

| | |
|---|---|
| ***H01Q 13/10*** | (2006.01) |
| ***H01Q 9/04*** | (2006.01) |
| ***H01Q 1/22*** | (2006.01) |
| ***H01Q 1/38*** | (2006.01) |
| ***H01Q 5/378*** | (2015.01) |

(52) U.S. Cl.

CPC ..... *H01Q 9/0407* (2013.01); *H01Q 1/2266* (2013.01); *H01Q 1/38* (2013.01); *H01Q 5/378* (2015.01); *H01Q 9/0421* (2013.01)

(58) Field of Classification Search

CPC ... H01Q 5/378; H01Q 9/0407; H01Q 9/0421; H01Q 13/106; H01Q 19/005

See application file for complete search history.

(56) References Cited

U.S. PATENT DOCUMENTS

| | | | | |
|---|---|---|---|---|
| 5,767,810 | A * | 6/1998 | Hagiwara | H01Q 9/0421 343/700 MS |
| 6,181,279 | B1 * | 1/2001 | Van Hoozen | H01Q 1/52 343/700 MS |
| 7,038,624 | B2 * | 5/2006 | Yegin | H01Q 9/0407 343/700 MS |
| 2009/0051598 | A1 * | 2/2009 | McCarrick | H01Q 1/243 343/700 MS |
| 2009/0153404 | A1 * | 6/2009 | Ryou | H01Q 9/0407 343/700 MS |

* cited by examiner

*Primary Examiner* — Hoang V Nguyen

(57) ABSTRACT

An antenna apparatus having a radiating plate, a ground layer, a dielectric layer, and a parasitic antenna is provided. The dielectric layer is disposed between the radiating plate and the ground layer, wherein the radiating plate is parallel to the ground layer, and the parasitic antenna is connected with the ground layer and perpendicular to the ground layer.

14 Claims, 4 Drawing Sheets

ANTENNA APPARATUS

BACKGROUND OF THE INVENTION

1. Field of the Invention

The invention relates to an antenna apparatus, and particularly relates to an antenna apparatus for improving a radiation pattern.

2. Description of Related Art

With the development of communication technology, the application of wireless communication technology in electronic products increases day by day, which results in the diversification of communication products. For example, cell phones, personal digital assistants (PDAs) with wireless network capability, and the global positioning system (GPS) are all related to wireless communication. In recent years, since consumers have more demands regarding the functions of communication products, communication products with various functions and designs have been developed, and computer network products with wireless communication capability have become more popular recently.

As for wireless communication products, the most crucial point is the design of an antenna, because the design quality of the antenna tends to influence the quality of communication. Generally, antennas include internal antennas and external antennas. External antennas include monopole antennas, dipole antennas and helix antennas. Internal antennas include planar inverted F antennas (PIFA) and microstrip antennas. The planar inverted F antennas are widely used in communication products.

The conventional wireless communication techniques mainly use patch antennas to generate a broadside radiation patterns. However, due to the space required by a patch antenna, patch antennas may not be applicable in miniatured communication products. As a result, the conventional way of handling this issue is to use the planar inverted F antennas to reduce the space taken by the antenna. However, the radiation patterns of the planar inverted F antennas are prone to be influenced by the components disposed around, so the distribution of the radiation patterns of the planar inverted F antennas is limited.

SUMMARY OF THE INVENTION

The invention provides an antenna apparatus capable of improving a radiation pattern of an antenna.

An antenna apparatus of the invention includes a radiating plate, a ground layer, a dielectric layer, and a parasitic antenna. The radiating plate is configured to receive or emit a radio frequency signal. The ground layer is configured for grounding. The dielectric layer is disposed between the radiating plate and the ground layer, and the radiating plate and the ground layer are parallel with each other. The parasitic antenna is connected with the ground layer, and an extending direction of the parasitic antenna is parallel to a normal direction of the ground layer.

In an embodiment of the invention, the radiating plate includes a feed-in part and a short circuit part. The feed-in part has a feed-in point. The radiating plate is electrically connected with a feed-in line through the feed-in part. The short circuit part is electrically connected with the ground layer.

In an embodiment of the invention, the radiating plate has an open slot, such that the radiating plate forms a C-shaped pattern, and an opening of the C-shaped pattern is adjacent to the feed-in part and the short circuit part.

In an embodiment of the invention, the parasitic antenna is disposed beside the opening of the C-shaped pattern.

In an embodiment of the invention, the C-shaped pattern has a long axis and a short axis, the opening of the C-shaped pattern is at a position close to the short axis and close to a side where the feed-in part and the short circuit part are disposed.

In an embodiment of the invention, a length of the C-shaped pattern is a multiple of a quarter of a wavelength of a frequency transmitted or received by the antenna apparatus.

In an embodiment of the invention, the antenna apparatus is a planar inverted F antenna.

In an embodiment of the invention, the radiating plate has a feed-in point.

In an embodiment of the invention, a geometric shape of the radiating plate includes rectangle, triangle, circle, and ellipse.

In an embodiment of the invention, the parasitic antenna is disposed external to an area of the radiating plate projected onto the ground layer.

In an embodiment of the invention, the antenna apparatus is a patch antenna.

In an embodiment of the invention, a length of the parasitic antenna is a multiple of a quarter of a wavelength of a frequency transmitted or received by the antenna apparatus.

In an embodiment of the invention, the ground layer is located on a printed circuit board.

Based on the above, the parasitic antenna that extends in the direction parallel to the normal direction of the ground layer is disposed on the ground layer in the invention to improve the radiation pattern of the antenna, thereby facilitating the communication quality of the electronic product using the antenna apparatus.

To make the above features and advantages of the invention more comprehensible, embodiments accompanied with drawings are described in detail as follows.

DESCRIPTION OF THE EMBODIMENTS

It is to be understood that both the foregoing and other detailed descriptions, features and advantages are intended to be described more comprehensively by providing an embodiment accompanied with figures hereinafter. The language used to describe the directions such as up, down, left, right, front, back or the like in the reference drawings is regarded in an illustrative rather than in a restrictive sense. Thus, the language used to describe the directions is not intended to limit the scope of the invention.

Figure 1:
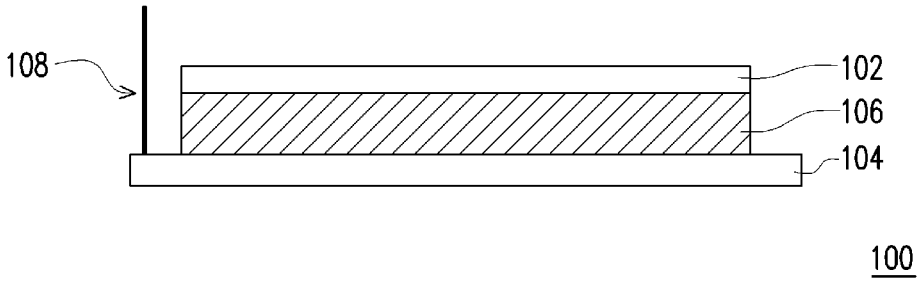
FIG. 1 is a schematic side view illustrating an antenna apparatus according to an embodiment of the invention.

FIG. 1 is a schematic side view illustrating an antenna apparatus according to an embodiment of the invention. Referring to FIG. 1, an antenna apparatus 100 includes a radiating plate 102, a ground layer 104, a dielectric layer 106, and a parasitic antenna 108. The dielectric layer 106 is disposed between the radiating plate 102 and the ground layer 104, and the radiating plate 102 and the ground layer 104 are parallel to each other. The radiating plate 102 may be a metal plate or a plate-like component with metal coated on its surface, and the radiating plate 102 is configured to receive or emit a radio frequency signal. The ground layer 104 may be a ground metal plate or a ground plane on a printed circuit board (PCB) for grounding.

In addition, the parasitic antenna 108 is connected with the ground layer 104. The parasitic antenna 108 is disposed external to an area of the radiating plate 102 projected onto the ground layer 104, and an extending direction of the parasitic antenna 108 is parallel to a normal direction of the ground layer 104. In addition, a length of the parasitic antenna 108 is a multiple of a quarter of a wavelength of a frequency transmitted or received by the antenna apparatus 100. By disposing the parasitic antenna 108 perpendicular to the ground layer 104 on the ground layer 104, a radiation pattern generated by the antenna apparatus 100 is allowed to be more condensed upwardly. Namely, signals radiated by the antenna apparatus 100 may be directed more consistently to the extending direction of the parasitic antenna 108, thereby facilitating a communication quality of an electronic product using the antenna apparatus 100.

Figure 2A:
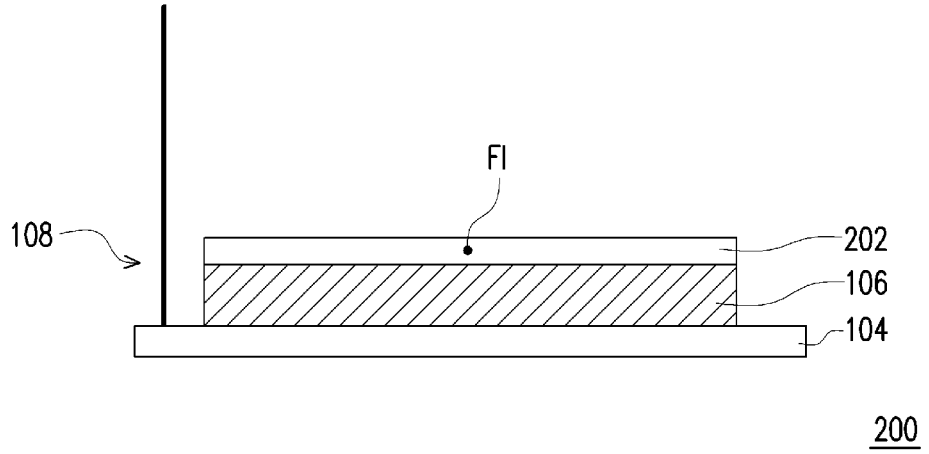
FIG. 2A is a schematic side view illustrating an antenna apparatus according to another embodiment of the invention.
Figure 2B:
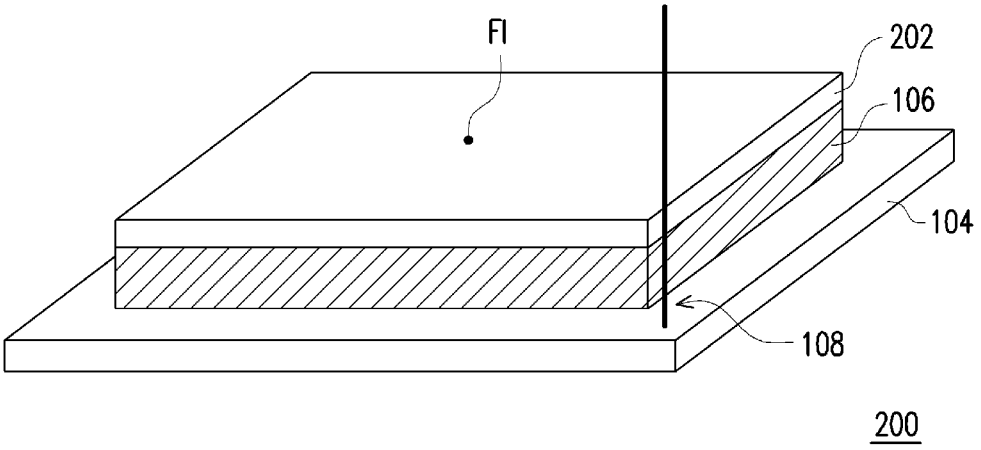
FIG. 2B is a schematic oblique view illustrating the antenna apparatus in the embodiment shown in FIG. 2A.

FIG. 2A is a schematic side view illustrating an antenna apparatus according to another embodiment of the invention. FIG. 2B is a schematic oblique view illustrating the antenna apparatus in the embodiment shown in FIG. 2A. As shown in FIGS. 2A and 2B, in this embodiment, an antenna apparatus 200 is a patch antenna, a radiating plate 202 is a rectangular metal plate or a plate-like component with metal coated on its surface, and there is a feed-in point FI on the radiating plate 202. The feed-in point FI may be connected with one end of a feed-in line (now shown), whereas another end of the feed-in line may be connected with a signal source (not shown), such that the signal source may feed signals to the feed-in point FI through the feed-in line, thereby sending the signals in a form of electromagnetic waves through the radiating plate 202. When a coaxial cable serves as the feed-in line, one end of a core conductor for signal transmission may be connected to the feed-in point FI, and another end that serves as an outer conductor for signal shielding is connected with the ground layer 104.

It should be noted that although the embodiment is described with the radiating plate 202 in a rectangular shape as an example, the shape of the radiating plate 202 is not limited thereto. In some embodiments, the radiating plate 202 may be shaped in other geometric forms, such as rectangle, triangle, circle, and ellipse, etc. In addition, a position of the feed-in point FI is not limited to the position shown in FIG. 2A, either. The designer may modify the position of the feed-in point FI according to the requirements in practical use.

Figure 2C:
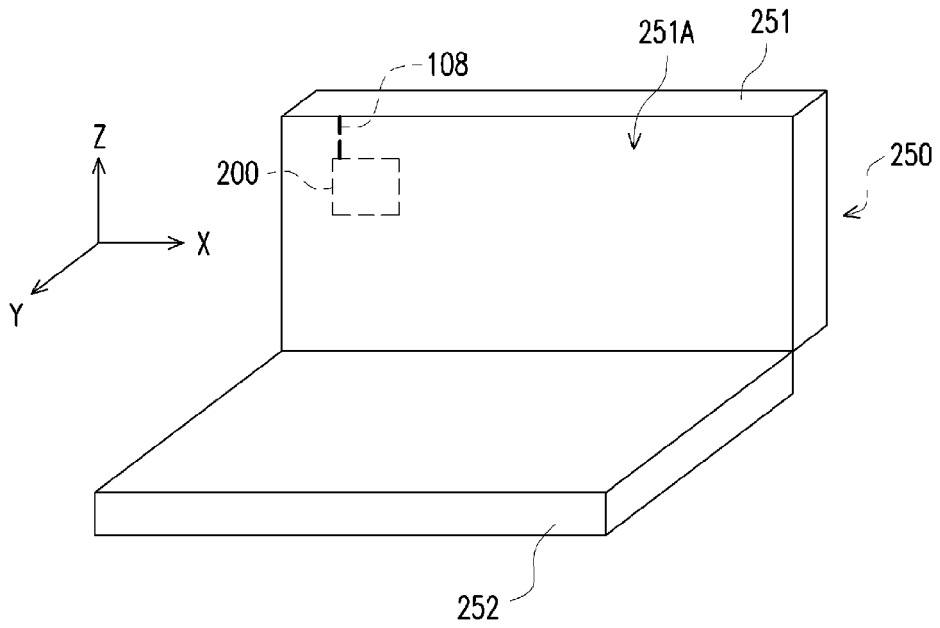
FIGS. 2C and 2D are schematic views illustrating a laptop computer disposed with an antenna apparatus according to an embodiment of the invention.
Figure 2D:
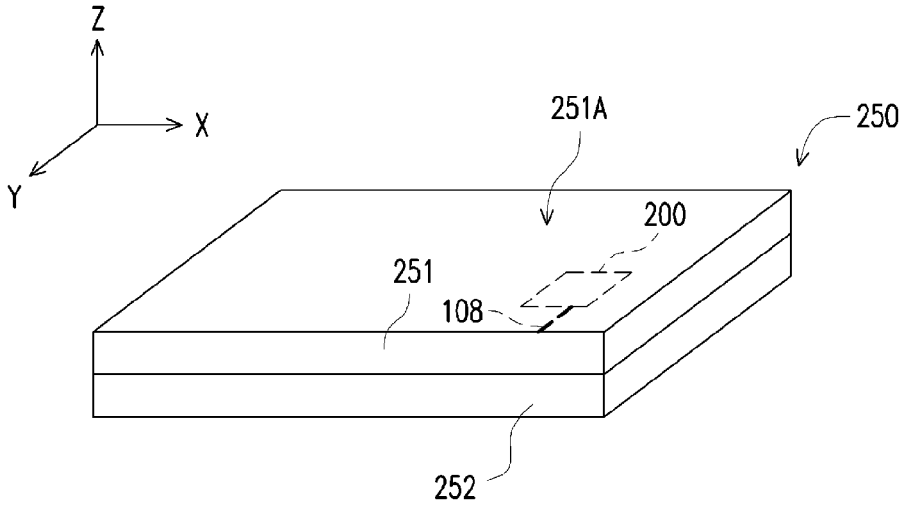

Furthermore, the parasitic antenna 108 is not limited to be perpendicular to the ground layer 104. The parasitic antenna 108 may be disposed as an adjustable antenna as well. FIGS. 2C and 2D are schematic views illustrating a laptop computer disposed with an antenna apparatus according to an embodiment of the invention. A laptop computer 250 shown in FIG. 2C includes a top cover 251 and a bottom cover 252. The top cover 251 further includes a display surface 251A. In this embodiment, the antenna apparatus 200 is disposed in the top cover 251, and an angle of the parasitic antenna 108 may be adjusted toward the Z-axis direction, i.e. parallel to an extending direction of a plane of the top cover 251, to obtain preferable signal transmission. It should be noted that the angle of the parasitic antenna 108 is not limited thereto. The angle of the parasitic antenna 108 may range within an included angle of the normal direction of the top cover 251 and the plane thereof. Referring to FIG. 2D, when the top cover is folded to the bottom cover 252 and the display surface 251A faces outside, the parasitic antenna 108 may stop functioning as being shielded by other components disposed in the bottom cover 252 of the laptop computer 250. And a signal-receiving signal direction then is a direction that the radiating plate 202 faces, i.e. the signal-receiving direction is still the z-axis direction.

Figure 3:
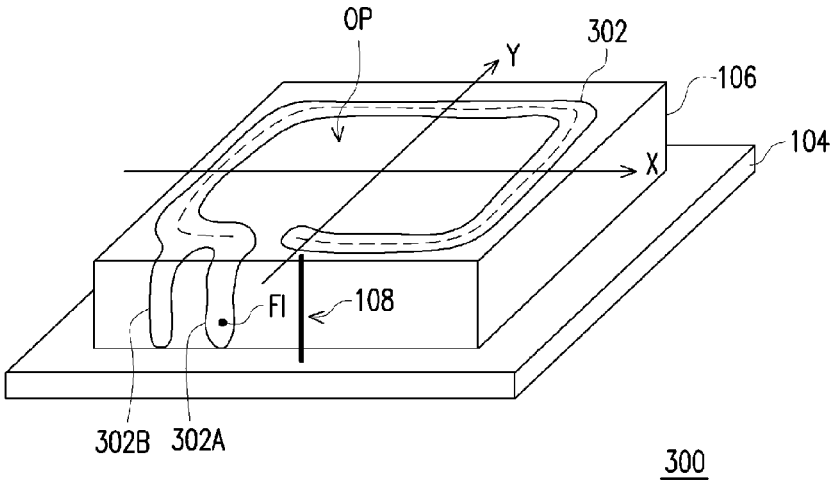
FIG. 3 is a schematic oblique view illustrating an antenna apparatus according to another embodiment of the invention.

FIG. 3 is a schematic oblique view illustrating an antenna apparatus according to another embodiment of the invention. The antenna apparatus 300 shown in FIG. 3 is a planar inverted F antenna. A radiating plate 302 further includes a feed-in part 302A and a short circuit part 302B extending toward a direction of the ground layer 104 in addition to a part parallel with the ground layer 104. The short circuit part 302B is electrically connected with the ground layer 104, and the feed-in part 302A has the feed-in point FI to be connected with the feed-in line (not shown) for receiving the signals from the signal source (not shown) and transmitting the signals to the radiating plate 302 parallel with the ground layer 104, thereby transmitting the signals in the form of electromagnetic waves. In addition, the radiating plate 302 parallel with the ground layer 104 includes an open slot OP, such that the radiating plate 302 parallel with the ground layer 104 is presented in a C-shaped pattern, and an opening of the C-shaped pattern is adjacent to the feed-in part 302A and the short circuit part 302B.

As shown in FIG. 3, the C-shaped pattern of the radiating plate 302 has a long axis X and a short axis Y, and the opening of the C-shaped pattern is close to the short axis Y and close to a side at which the feed-in part 302A and the short circuit part 302B are disposed. In addition, the parasitic antenna 108 is disposed beside the opening of the C-shaped pattern, so as to make a radiation pattern generated by the antenna apparatus 300 more condensed upwardly, thereby improving a communication quality of an electronic product using the antenna apparatus 300. The length of the parasitic antenna 108 is a multiple of a quarter of a wavelength of a frequency transmitted or received by the antenna apparatus 300, and a length of the C-shaped pattern (indicated by a length of a dotted line shown in FIG. 3) is also a multiple of a quarter of the wavelength of the frequency transmitted or received by the antenna apparatus 300.

It should be noted that the opening of the C-shaped pattern described above is not limited to a position shown in the embodiment of FIG. 3. The designer may dispose the opening of the C-shaped pattern to a different position according to practical use. The antenna 108 is then disposed in a different position as the position of the opening of the C-shaped pattern differs. In addition, the C-shaped pattern is not limited to necessarily have the long and short axes. For example, the C-shaped pattern may substantially be a circular pattern having an opening.

In some embodiments, the pattern of the radiating plate 302 parallel to the ground layer 104 may not be limited to the C-shaped pattern. The designer may design an antenna pattern for the radiating plate 302 as required according to practical use. By disposing the parasitic antenna 108 perpendicular to the ground layer 104 on the ground layer 104, the radiation pattern of the antenna apparatus becomes condensed upwardly, thereby facilitating the communication quality of the electronic product using the antenna apparatus.

Figure 4:
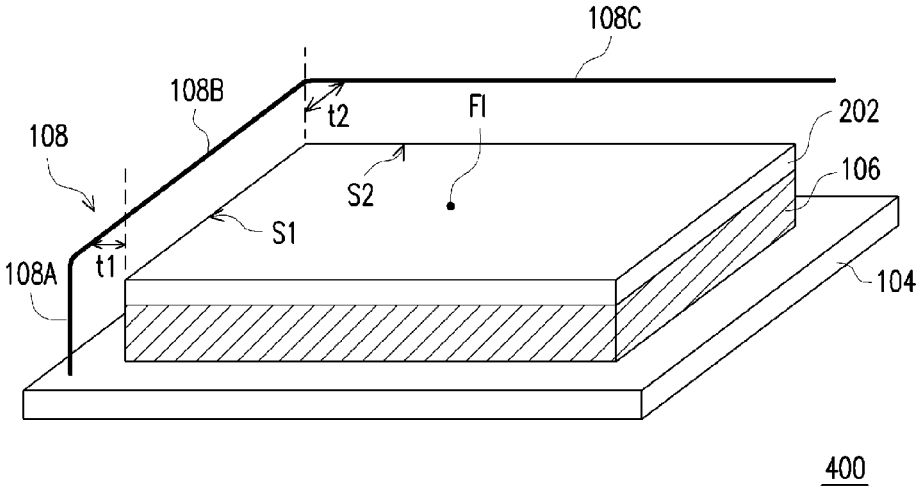
FIG. 4 is a schematic oblique view illustrating an antenna apparatus according to another embodiment of the invention.

It should be noted that the embodiment regarding the parasitic antenna 108 of the antenna apparatus is only an exemplary embodiment. The parasitic antenna 108 is not required to be strictly perpendicular to the ground layer 104 in practical use. For example, FIG. 4 is a schematic oblique view illustrating an antenna apparatus according to another embodiment of the invention. Referring to FIG. 4, an antenna apparatus 400 of this embodiment differs from the antenna apparatus 200 in that the parasitic antenna 108 includes a vertical part 108A, a first extension part 108B, and a second extension part 108C, while the length of the parasitic antenna 108 in total is still a multiple of a quarter of a wavelength of a frequency transmitted or received by the antenna apparatus 400. The vertical part 108A and the first extension part 108B are located at a first side S1 of the radiating plate 202. One end of the vertical part 108A is connected with the ground layer 104, and an extending direction of the vertical part 108A is parallel to the normal direction of the ground layer 104. One end of the first extension part 108B is connected with another end of the vertical part 108A, and an extending direction of the first extension part 108B is parallel to the first side S1 of the radiating plate 202 and the ground layer 104. In addition, an included angle of a plane formed by the first extension part 108B and the first side S1 and a plane of the radiating plate 202 ranges between 15° and 80°, a horizontal distance between the first extension part 108B and the first side S1 of the radiating plate 202 is a first length t1, and the first length t1 substantially ranges between 1 to 3 mm. Moreover, the second extension part 108C is connected with another end of the first extension part 108B, an extending direction of the second extension part 108C is parallel to a second side S2 of the radiating plate 202, and a horizontal distance between the second extension part 108C and the second side S2 of the radiating plate 202 is a second length t2, and the second length t2 substantially ranges between 1 to 3 mm. A total length of the vertical part 108A, the first extension part 108B, and the second extension part 108C is greater than or equal to one-eighth of the wavelength of the frequency transmitted or received by the antenna apparatus 300 Besides, in some embodiments, shapes of the first extension part 108B and the second extension part 108C are not limited to the shapes of the first extension part 108B and the second extension part 108C shown in this embodiment. In some embodiments, the first extension part 108B and the second extension part 108C may be in different shapes to extend to the above of the radiating plate 202, so as to adjust a radiation pattern of the antenna apparatus 400.

In view of the above, the parasitic antenna that extends in the direction parallel to the normal direction of the ground layer is disposed on the ground layer in the invention to improve the radiation pattern of the antenna, thereby facilitating the communication quality of the electronic product using the antenna apparatus.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An antenna apparatus, including:

a radiating plate for receiving or emitting a radio frequency signal;

a ground layer for grounding;

a dielectric layer, disposed between the radiating plate and the ground layer, wherein the radiating plate and the ground layer are parallel with each other; and a parasitic antenna, connected with the ground layer, wherein an extending direction of the parasitic antenna is parallel to a normal direction of the ground layer such that a radiation pattern generated by the antenna apparatus is condensed in the extending direction, and wherein the parasitic antenna does not form a closed loop;

wherein the radiating plate further comprises:

a feed-in part, having a feed-in point, wherein the radiating plate is electrically connected with a feed-in line through the feed-in part;

a short circuit part, electrically connected with the ground layer; and an open slot, such that the radiating plate forms a C-shaped pattern, and an opening of the C-shaped pattern is adjacent to the feed-in part and the short circuit part.

2. The antenna apparatus as claimed in claim 1, wherein the parasitic antenna is disposed beside the opening of the C-shaped pattern.

3. The antenna apparatus as claimed in claim 1, wherein the C-shaped pattern has a long axis and a short axis, the opening of the C-shaped pattern is at a position close to the short axis and close to a side where the feed-in part and the short circuit part are disposed.

4. The antenna apparatus as claimed in claim 1, wherein a length of the C-shaped pattern is a multiple of a quarter of a wavelength of a frequency transmitted or received by the antenna apparatus.

5. The antenna apparatus as claimed in claim 1, wherein the antenna apparatus is a planar inverted F antenna.

6. The antenna apparatus as claimed in claim 1, wherein a geometric shape of the radiating plate comprises rectangle, triangle, circle, and ellipse.

7. The antenna apparatus as claimed in claim 6, wherein the parasitic antenna is disposed external to an area of the radiating plate projected onto the ground layer.

8. The antenna apparatus as claimed in claim 6, wherein the antenna apparatus is a patch antenna.

9. The antenna apparatus as claimed in claim 1, wherein a length of the parasitic antenna is a multiple of a quarter of a wavelength of a frequency transmitted or received by the antenna apparatus.

10. The antenna apparatus as claimed in claim 1, wherein the ground layer is located on a printed circuit board or is a ground metal plate.

11. An antenna apparatus, including:

a radiating plate for receiving or emitting a radio frequency signal;

a ground layer for grounding;

a dielectric layer, disposed between the radiating plate and the ground layer, wherein the radiating plate and the ground layer are parallel with each other; and a parasitic antenna, connected with the ground layer, the parasitic antenna comprising:

a vertical part, wherein one end of the vertical part is connected with the ground layer, and an extending direction of the vertical part is parallel to the normal direction of the ground layer;

a first extension part, wherein one end of the first extension part is connected with another end of the vertical part, an extending direction of the first extension part is parallel to a first side of the radiating plate and the ground layer, and a horizontal distance between the first extension part and the first side of the radiating plate is a first length; and a second extension part, connected with another end of the first extension part and an extending direction of the second extension part is parallel to a second side of the radiating plate, and a horizontal distance between the second extension part and the second side of the radiating plate is a second length.

12. The antenna apparatus as claimed in claim 11, wherein the first length substantially ranges between 1 to 3 mm.

13. The antenna apparatus as claimed in claim 11, wherein the second length substantially ranges between 1 to 3 mm.

14. The antenna apparatus as claimed in claim 11, wherein a total length of the vertical part, the first extension part, and the second extension part is greater than or equal to one-eighth of a wavelength of a frequency transmitted or received by the antenna apparatus.

* * * * *